US008721041B2

(12) United States Patent
Broderick et al.

(10) Patent No.: US 8,721,041 B2
(45) Date of Patent: May 13, 2014

(54) PRINTHEAD HAVING A STEPPED FLOW PATH TO DIRECT PURGED INK INTO A COLLECTING TRAY

(75) Inventors: Joseph Andrew Broderick, Wilsonville, OR (US); David Paul Platt, Newberg, OR (US); Isaac S. Frazier, Portland, OR (US); Tony Russell Rogers, Milwaukie, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/572,760

(22) Filed: Aug. 13, 2012

(65) Prior Publication Data

US 2014/0043412 A1 Feb. 13, 2014

(51) Int. Cl.
*B41J 2/165* (2006.01)
*B41J 2/185* (2006.01)

(52) U.S. Cl.
USPC ..... 347/36; 347/90

(58) Field of Classification Search
CPC ..... B41J 2/1604
USPC ..... 347/103, 99, 85, 20, 36, 90
See application file for complete search history.

(56) References Cited

U.S. PATENT DOCUMENTS 3,916,421 A * 10/1975 Hertz ..... 347/73
3,946,405 A * 3/1976 Berry et al. ..... 347/90
4,024,548 A * 5/1977 Alonso et al. ..... 347/34
4,491,433 A 1/1985 Shiurila et al.
4,628,331 A * 12/1986 Ishikawa ..... 347/34
4,890,119 A * 12/1989 Eremity et al. ..... 347/90
4,970,535 A * 11/1990 Oswald et al. ..... 347/25
5,659,346 A * 8/1997 Moynihan et al. ..... 347/68
5,821,963 A 10/1998 Sutera et al.
6,402,314 B1 * 6/2002 Sato et al. ..... 347/98
6,682,181 B1 * 1/2004 Moynihan et al. ..... 347/71
6,851,796 B2 * 2/2005 Jeanmaire et al. ..... 347/74
6,904,718 B2 6/2005 Fox
7,048,353 B2 5/2006 Waller et al.
7,048,369 B2 * 5/2006 Rousseau et al. ..... 347/103
7,210,773 B2 5/2007 Jones
7,210,774 B2 5/2007 Jones
7,399,068 B2 * 7/2008 Anagnostopoulos et al. .. 347/73
7,883,198 B2 * 2/2011 McCracken et al. ..... 347/99
7,901,035 B2 3/2011 Koehler et al.

(Continued)

FOREIGN PATENT DOCUMENTS

JP 3-151247 A 6/1991

OTHER PUBLICATIONS

European Search Report corresponding to European Application No. 09 17 5532, European Patent Office, HV Rijswijk, Netherlands, Aug. 3, 2010 (6 pages).

*Primary Examiner* — Matthew Luu
*Assistant Examiner* — Patrick King
(74) *Attorney, Agent, or Firm* — Maginot, Moore & Beck, LLP

(57) ABSTRACT

An ink collecting system has been developed to direct ink purged from a printhead positioned above an ink collecting tray along a stepped flow path into the ink collecting tray. The stepped flow path enables the purged ink to flow from a faceplate on the jet stack, around a junction, onto a lower surface of the jet stack, and to a curved lower flange of a reservoir housing, which directs the ink away from the faceplate before the ink drops into the ink collecting tray for disposal or reuse.

10 Claims, 3 Drawing Sheets

(56) References Cited

U.S. PATENT DOCUMENTS

| | | | | |
|---|---|---|---|---|
| 2002/0152692 | A1 | 10/2002 | Bahroos et al. | |
| 2004/0104959 | A1* | 6/2004 | Brown et al. | 347/22 |
| 2004/0114006 | A1 | 6/2004 | Phillips | |
| 2005/0285917 | A1 | 12/2005 | Nichols et al. | |
| 2006/0141167 | A1* | 6/2006 | Asuke | 427/487 |
| 2006/0244799 | A1 | 11/2006 | Sasa et al. | |
| 2007/0008372 | A1 | 1/2007 | Katada | |
| 2007/0076048 | A1 | 4/2007 | Cunnington et al. | |
| 2007/0126783 | A1 | 6/2007 | Deshon-Stepp et al. | |
| 2009/0033727 | A1 | 2/2009 | Anagnostopoulos et al. | |
| 2009/0102906 | A1* | 4/2009 | Phillips et al. | 347/88 |
| 2010/0110117 | A1* | 5/2010 | McCracken et al. | 347/6 |
| 2010/0123764 | A1 | 5/2010 | Slotto et al. | |
| 2010/0220145 | A1 | 9/2010 | Koehler et al. | |
| 2011/0012967 | A1 | 1/2011 | Hsu et al. | |
| 2011/0242228 | A1 | 10/2011 | Link et al. | |
| 2011/0261110 | A1 | 10/2011 | Lu et al. | |

* cited by examiner

PRINTHEAD HAVING A STEPPED FLOW PATH TO DIRECT PURGED INK INTO A COLLECTING TRAY

TECHNICAL FIELD

This disclosure relates generally to inkjet printers, and, more particularly, to printheads in such printers.

BACKGROUND

In general, inkjet printing machines or printers include at least one printhead that ejects drops or jets of liquid ink onto an image receiving member, which may be media, either in sheet or web form, or a rotating intermediate member from which the ink is later transferred to media. A phase-change inkjet printer employs phase change inks that are solid at ambient temperature, but transition to a liquid phase at an elevated temperature. The melted ink can then be ejected by a printhead to form an ink image on the image receiving member. When the image receiving member is a rotating intermediate member, a layer of release agent is applied to the intermediate imaging member, such as a rotating drum or belt, to facilitate the transfer of the ink image to a receiving substrate, such as a sheet of paper, as the substrate passes through a nip formed between a transfer roller and the intermediate imaging member.

In various modes of operation, ink is purged from the printheads to ensure proper operation of the printhead. During purging, ink is typically forced through the ink pathways, chambers, and out of the inkjet apertures in the faceplate of the printhead by pressure applied to an ink reservoir in the printhead. This pressure urges debris and/or air bubbles out of the printhead along with some of the ink. Such clearing action enables malfunctioning inkjets to recover the ability to eject ink properly again. The purged ink flows down and off the face of the printhead, typically into a waste tray positioned below the printhead for removal from the printer or into an ink collecting tray mounted on the bottom of the printhead for reuse in the printer.

Printers have limited space in which to mount an ink collecting tray to the bottom of the printhead. The ink collecting tray must be positioned such that the tray does not interfere with the rotating imaging drum in an indirect printer or the media web in a continuous direct printer, both of which are positioned adjacent to the printhead to enable the printhead to eject ink onto the drum or web. Thus, to avoid interfering with the drum, the ink collecting tray can extend only slightly beyond the printhead face in an indirect printer. In a continuous direct printer, the ink collecting tray must be positioned substantially even with the printhead face to avoid interference with the media web. Purged ink that flows rapidly down a printhead face can miss the ink collecting tray or splash out of the tray and land on the drum or other components of the printer. Previously known printheads included drip bibs to catch the purged ink and direct it to the waste or ink collecting tray. However, the drip bibs add components to the construction of a printhead and require space to accommodate the bib profile within the printer. Thus, improved handling of ink purged from a printhead would be beneficial.

SUMMARY

In one embodiment a printing apparatus has been developed that directs purged ink along a stepped flow path from the printhead face to an ink collecting tray. The apparatus includes a tray having a first end and a second end, a jet stack, and a reservoir housing. The jet stack has a lower surface that joins a faceplate containing a plurality of apertures at a junction, and each aperture in the plurality of apertures includes an inkjet ejector. The faceplate is positioned above the tray between the first end and the second end of the tray and configured to enable ink purged through the inkjet ejectors to flow down the faceplate under gravity, around the junction between the faceplate and lower surface, and onto the lower surface of the jet stack. The reservoir housing forms an ink reservoir that is fluidly connected to the inkjet ejectors. The reservoir housing is positioned between the jet stack and the second end of the tray and includes a lower flange configured to extend below the lower surface of the jet stack to receive ink from the lower surface of the jet stack. The lower flange has a curvature that enables the ink received from the jet stack to flow toward the second end of the tray and drop into the tray between the first and second ends of the tray.

In another embodiment a printer has been developed that includes a printhead configured to direct ink along a stepped flow path into an ink collecting tray. The printer includes a rotating imaging drum, a tray having a first end and a second end, and a printhead positioned adjacent the rotating imaging drum. The printhead includes a jet stack and a reservoir housing. The jet stack has a lower surface that joins a faceplate containing a plurality of apertures at a junction, and each aperture in the plurality of apertures includes an inkjet ejector configured to eject ink onto a surface of the rotating imaging drum. The faceplate is positioned above the tray between the first end and the second end of the tray and configured to enable ink purged through the inkjet ejectors to flow down the faceplate under gravity, around the junction between the faceplate and lower surface, and onto the lower surface of the jet stack. The reservoir housing forms an ink reservoir that is fluidly connected to the inkjet ejectors. The reservoir housing is positioned between the jet stack and the second end of the tray and includes a lower flange configured to extend below the lower surface of the jet stack to receive ink from the lower surface of the jet stack. The lower flange has a curvature that enables the ink received from the jet stack to flow toward the second end of the tray and drop into the tray between the first and second ends of the tray.

In yet another embodiment another printer has been developed that includes a printhead configured to direct ink along a stepped flow path into an ink collecting tray. The printer includes a media web, a tray having a first end and a second end, and a printhead positioned adjacent the media web. The printhead comprises a jet stack and a reservoir housing. The jet stack has a lower surface that joins a faceplate containing a plurality of apertures at a junction, and each aperture in the plurality of apertures includes an inkjet ejector configured to eject ink onto a surface of the media web. The faceplate is positioned above the first end of the tray and configured to enable ink purged through the inkjet ejectors to flow down the faceplate under gravity, around the junction between the faceplate and lower surface, and onto the lower surface of the jet stack. The reservoir housing forms an ink reservoir that is fluidly connected to the inkjet ejectors. The reservoir housing is positioned between the jet stack and the second end of the tray and includes a lower flange configured to extend below the lower surface of the jet stack to receive ink from the lower surface of the jet stack. The lower flange has a curvature that enables the ink received from the jet stack to flow toward the second end of the tray and drop into the tray between the first and second ends of the tray.

DETAILED DESCRIPTION

Figure 1:
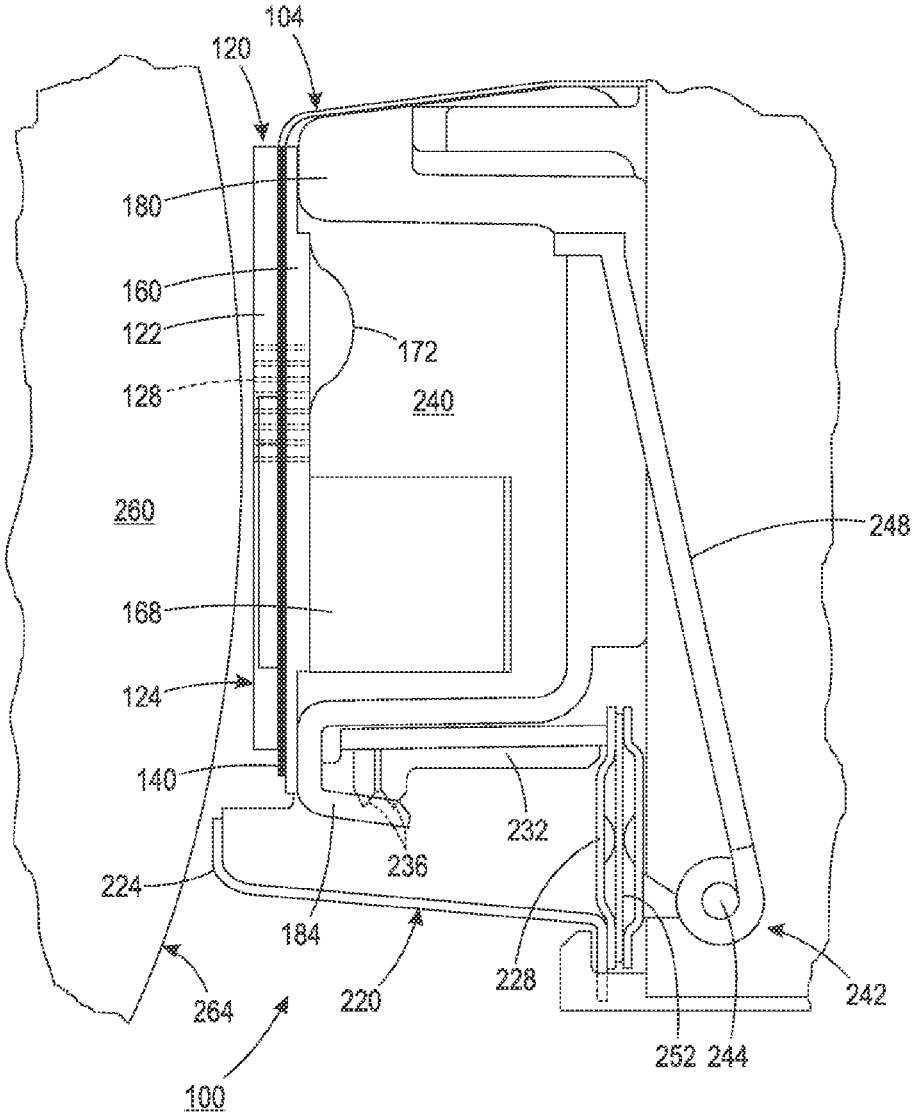
FIG. 1 is a side cross-sectional view of a printhead, tray, and imaging drum.

For a general understanding of the present embodiments, reference is made to the drawings. In the drawings, like reference numerals have been used throughout to designate like elements. As used herein, the terms "printer," "printing device," or "imaging device" generally refer to a device that produces an image with one or more colorants on print media and may encompass any such apparatus, such as a digital copier, bookmaking machine, facsimile machine, multi-function machine, or the like, which generates printed images for any purpose. Image data generally include information in electronic form that are rendered and used to operate the inkjet ejectors to form an ink image on the print media. These data may include text, graphics, pictures, and the like. The operation of producing images with colorants on print media, for example, graphics, text, photographs, and the like, is generally referred to herein as printing or marking. Phase-change ink printers use phase-change ink, also referred to as a solid ink, which is in a solid state at room temperature but melts into a liquid state at a higher operating temperature. The liquid ink drops are printed onto an image receiving surface in either a direct or indirect printer.

The term "printhead" as used herein refers to a component in the printer that is configured with inkjet ejectors to eject ink drops onto an image receiving surface. A typical printhead includes a plurality of inkjet ejectors that eject ink drops of one or more ink colors onto the image receiving surface in response to firing signals that operate actuators in the inkjet ejectors. The inkjets are arranged in an array of one or more rows and columns. In some embodiments, the inkjets are arranged in staggered diagonal rows across a face of the printhead. Various printer embodiments include one or more printheads that form ink images on an image receiving member. Some printer embodiments include a plurality of printheads arranged in a print zone. An image receiving member, such as a print medium or an intermediate member, moves past the printheads in a process direction through the print zone. The inkjets in the printheads eject ink drops in rows in a cross-process direction, which is perpendicular to the process direction across the image receiving surface.

In an indirect printer, the printheads eject ink drops onto the surface of an intermediate image receiving member, for example, a rotating drum or an endless belt. A transfer roller is selectively positioned against the intermediate image receiving member to form a transfer nip. As a media sheet passes through the transfer nip in synchronization with the ink image on the intermediate image receiving member, the ink image transfers and, in some printers, fixes to the media sheet under pressure and heat in the transfer nip. The transfer and fixation of the ink image are well known to the art and are referred to as a transfix process.

In a direct printer, the printheads eject ink drops directly onto a print medium, for example, a paper sheet or a continuous media web. After ink drops are printed on the print medium, the printer moves the print medium through a nip formed between two rollers that apply pressure and, optionally, heat to the ink drops and print medium. One roller, typically referred to as a "spreader roller," contacts the printed side of the print medium. The second roller, typically referred to as a "pressure roller," presses the media against the spreader roller to spread the ink drips and fix the ink to the print medium.

FIG. 1 depicts an ink collecting system 100 including a printhead 104, a collecting tray 220, and an ink recirculation system 242. The printhead 104 is positioned adjacent to an imaging drum 260 to enable inkjets in the printhead 104 to eject ink onto a surface 264 of the imaging drum 260, which is coated with a release agent layer, to form an image on the release agent layer. The ink collecting tray 220 includes a first end 224, a second end 228, and a roof 232. The tray 220 is positioned beneath the printhead 104 to enable ink from the printhead 104 to flow downwardly under the effect of gravity into the tray 220. The first end 224 of the tray 220 extends beyond the front of the printhead 104 at a predetermined distance from the imaging drum 260 where the tray 220 does not interfere with the imaging drum 260, while the second end 228 is substantially aligned with the back of the printhead 104. The tray 220 of the embodiment of FIG. 1 is sloped downwardly from the first end 224 to the second end 228 to enable ink collected in the tray 220 to flow toward the second end 228 of the tray 220. The second end 228 of the ink collecting tray 220 includes at least one opening to enable the ink in the second end 228 of the tray 220 to flow into the ink recirculation system 242. In some embodiments, the second end of the ink collecting tray does not include a wall, enabling the ink to flow directly into the ink recirculation system. The roof 232 of the tray 220 is positioned between a floor of the tray 220 and the reservoir housing 180. The tray roof 232 includes sealing members 236, which extend in the cross-process direction across the width of the printhead 104 in the cross-process direction to seal the reservoir housing 180 with a lower flange 184 and enclose the upper portion of the tray 220 to prevent ink from collecting on the bottom of the reservoir housing 180 or above the lower flange 184. In one embodiment, the sealing members 236 and the exposed lower surface of the tray roof 232 are formed of silicone to form a tight seal and to prevent ink from adhering to the surface of the sealing members 236 and tray roof 232, though, in other embodiments, other hydrophobic materials or coatings are used. In some embodiments, the tray roof includes an aluminum layer positioned between the silicone layer and the reservoir housing to provide additional rigidity and heat conduction to the tray roof.

In some embodiments, the printer can be configured with a waste tray that is not attached to the printhead instead of the ink collecting tray. The waste tray is positioned below the printhead at a distance where the waste tray does not interfere with the rotating drum. The waste tray is configured to receive the ink purged from the printhead and is removable to enable a user to remove the waste tray and dispose of the ink in the waste tray.

The printhead 104 includes a jet stack 120, a heater shield 160, a reservoir housing 180, and an ink reservoir 240. The jet stack 120 includes a brazed portion 122 and an adhesive layer 140. The brazed portion 122 is formed of a plurality of brazed plates bonded together, one of which is the jet stack faceplate 124. The faceplate 124 includes a plurality of apertures, each aperture including an inkjet ejector 128 that is fluidly connected to the ink reservoir 240 through passages and manifolds in the jet stack 120 and heater shield 160. The faceplate 124 faces the imaging drum 260 to enable the inkjet ejectors 128 to eject drops of ink onto the release agent layer on the surface 264 of the imaging drum 260 in response to electrical signals being delivered to the ejectors 128 from a controller (not shown). The adhesive layer 140 of the jet stack 120 bonds the back of the brazed portion 122 of the jet stack 120 to the heater shield 160 and includes one or more layers of adhesive, a heater, and flexible pathways to fluidly connect the inkjet ejectors 128 to the ink reservoir 240. As discussed below, the adhesive layer 140 extends below the brazed portion 122 to form part of the stepped flow path directing the ink from the faceplate 124 to the tray 220.

The heater shield 160 bonded to the jet stack 120 by the adhesive layer 140 is also attached to a heat sink 168 and a heater 172. The heater shield 160 is formed of a thermally conductive material to enable the heater shield 160 to spread the heat generated by the heater 172 uniformly across the printhead 104 and conduct the heat to the jet stack 120 and ink reservoir 240. The heat sink 168 is positioned on the back of the heater shield 160, within the ink reservoir 240, to enable the heat shield 160 and the heat sink 168 to conduct heat generated by the heater 172 to the reservoir 240 and melt ink in the ink reservoir 240. The heater shield 160 extends below the adhesive layer 140 of the jet stack 120 to form another portion of the stepped flow path for ink to travel from the printhead 104 to the tray 220.

The reservoir housing 180 is substantially C-shaped, with each end in the cross-process direction being enclosed to enable the open end of the reservoir housing 180 to be sealed to the back of the heater shield 160 to define a volume between the heater shield 160 and the reservoir housing 180. The volume within the reservoir housing 180 forms the ink reservoir 240, which stores ink received from ink melting assemblies (not shown) until the ink is ejected by or purged from the inkjet ejectors 128. The reservoir housing 180 includes a lower flange 184 extending downwardly and curving away from a junction with the bottom of the heater shield 160 towards the second end 228 of the collecting tray 220. The lower flange 184 increases the structural integrity of the reservoir housing 180 and, as is discussed in detail below, provides a portion of the flow path for ink to flow from the jet stack faceplate 124 into the tray 220.

The ink recirculation system 242 includes a pump 244, a recirculation path 248, and a filter 252. The ink collected in the tray 220 flows down the sloped tray floor toward the second end 228 of the tray 220 and through the filter 252 to remove particles and debris in the ink and prepare the ink for reuse. The ink is moved by pump 244 through the recirculation path 248 back to the ink reservoir 240 in the printhead 104. Although the embodiment of FIG. 1 includes an ink recirculation system, in some embodiments having a waste tray that is not attached to the printhead, the ink is not recirculated, and the tray is manually removed and emptied when full.

Figure 2:
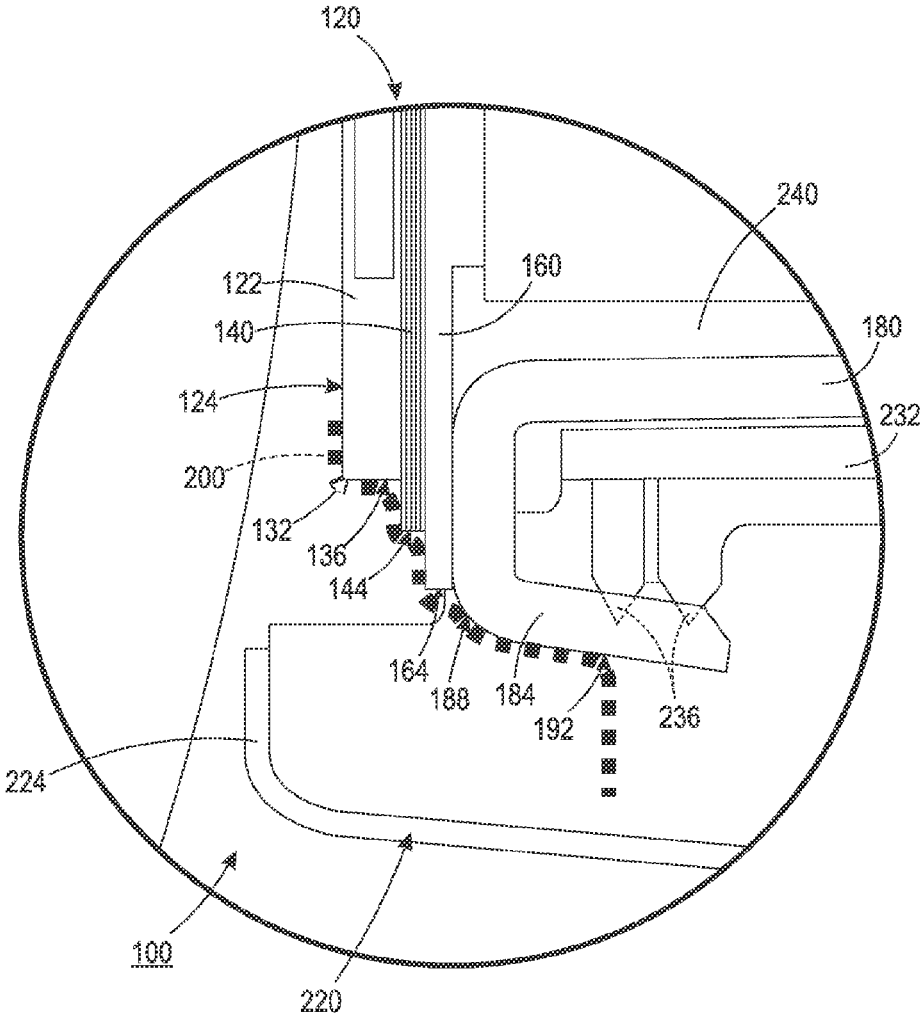
FIG. 2 is a detail side cross-sectional view of a stepped flow path in the embodiment of FIG. 1.

FIG. 2 is a detail view of the stepped flow path 200 and the elements that form the stepped flow path 200. The brazed portion 122 of the jet stack 120 includes a lower surface 136 and a junction 132 between the faceplate 124 and the lower surface 136. The junction 132 is configured to enable ink flowing down the faceplate 124 to flow around the junction 132 and be directed to the lower surface 136 of the brazed portion 122 as the surface energy of the ink holds the ink on the lower surface 136. The adhesive layer 140 of the jet stack 120 contacts and extends below the lower surface 136 of the brazed portion 122 to enable ink to transfer from the lower surface 136 of the brazed portion 122 onto the adhesive layer 140. Ink then moves down the front of the adhesive layer 140 to a lower surface 144 of the adhesive layer 140, where the ink is again held on the lower surface 144 by the surface energy in the ink. The ink is directed to a portion of the heater shield 160 that contacts and extends below the lower surface 144 of the adhesive layer 140, where the ink flows downwardly by gravity to a lower surface 164 of the heater shield 160. A curved surface 188 on the lower flange 184 of the reservoir housing 180 receives the ink urged by gravity from the lower surface 164 of the heater shield 160. Surface tension forces in the ink enable the ink to flow along the curved surface 188 and then lower surface 192 of the lower flange 184 toward the second end 228 (FIG. 1) of the ink collecting tray 220 until gravity pulls the ink into the tray 220. In some embodiments, any or all of the lower surfaces 136, 144, and 164, and the portions of the adhesive layer 140, the heater shield 160, and the lower flange 184 that contact ink can be coated with a hydrophobic agent, for example polytetrafluouroethylene (commonly referred to as PTFE and sold commercially as Teflon®) or silicone oil. The reader should appreciate that additional elements of the printhead can be configured as part of the stepped flow path, and that some of the surfaces forming the stepped flow path can be angled or curved in various configurations to facilitate the flow of ink through the flow path and into the tray.

When the printer in which the printing apparatus is installed performs a purge cycle, pressure is applied to the ink reservoir 240. Ink flows from the inkjet ejectors 128 (FIG. 1) in response to the pressure in the ink reservoir 240. The ink flows down the jet stack faceplate 124 until the ink reaches the junction 132 between the faceplate 124 and the lower surface 136 of the brazed portion 122 of the jet stack 120. The ink follows the stepped flow path 200, flowing around the junction 132 to the lower surface 136 of the brazed portion 122, the adhesive layer 140 of the jet stack 120, the lower surface 144 of the adhesive layer 140, the heater shield 160, the lower surface 164 of the heater shield 160, the curved surface 188 of the lower flange 184 of the reservoir housing 180, and the upper lower surface 192 of the lower flange 184, before dripping into the ink collecting tray 220, or, in some embodiments, a waste tray. The surface energy of the ink enables the ink to follow the stepped flow path 200 to move toward the second end 228 of the ink collecting tray 220 before dropping into the ink collecting tray 220.

Figure 3:
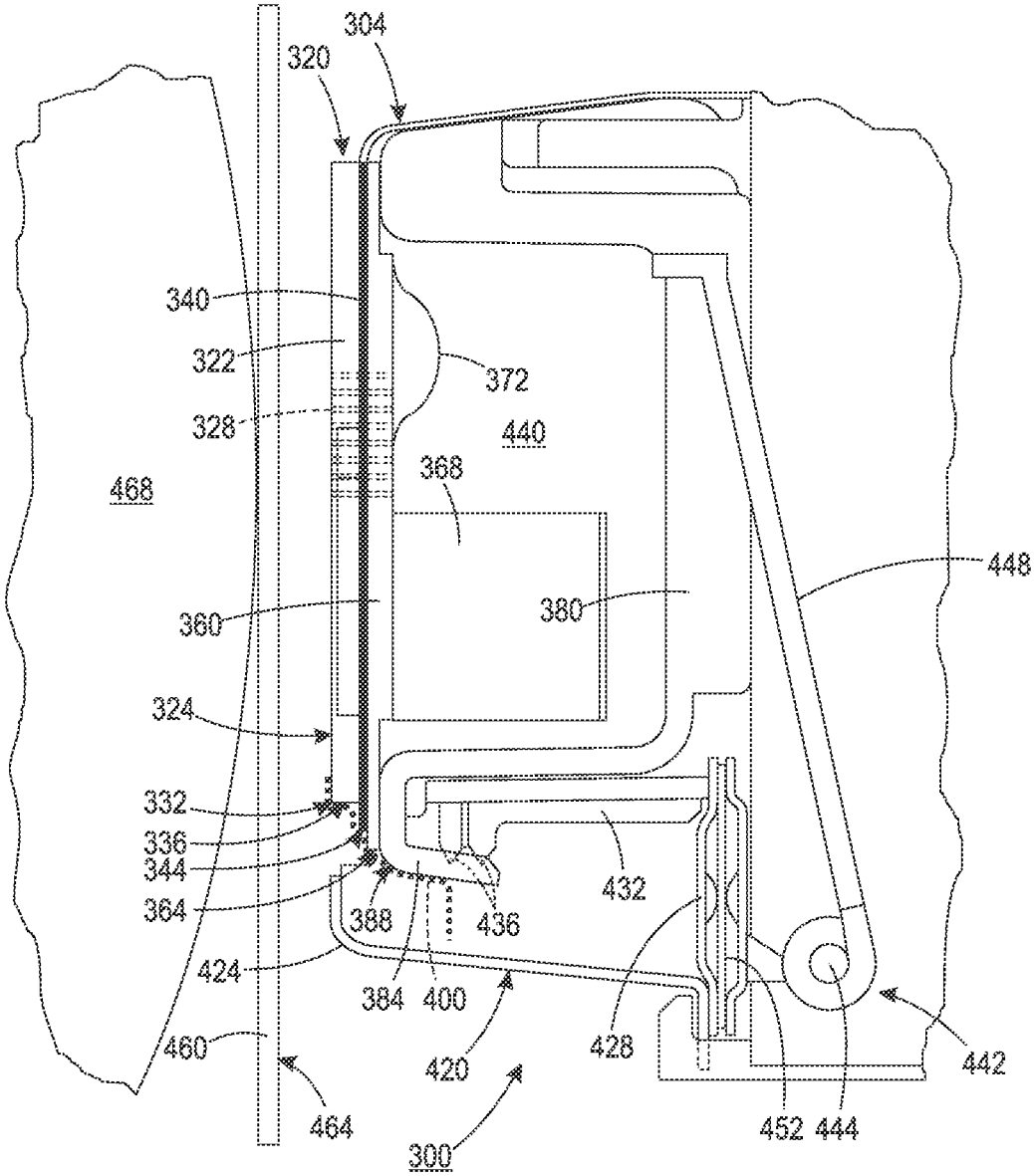
FIG. 3 is a side cross-sectional view of another printhead, tray, and media web.

FIG. 3 depicts an ink collecting system 300 for use in a continuous direct printer that includes a printhead 304, a collecting tray 420, and an ink recirculation system 442. The printhead 304 is positioned adjacent to a continuous media web 460 and a backing member 468, which maintains the web 460 under tension in a position to enable inkjets in the printhead 304 to eject ink onto a surface 464 of the media web 460 to form an ink image on the surface 464 of the web 460. The ink collecting tray 420 includes a first end 424, a second end 428, and a roof 432. The ink collecting tray 420 is attached to the bottom of the printhead 304 to enable ink from the printhead 304 to flow downwardly under gravity into the tray 420. The first end 424 of the tray 420 is substantially aligned with the front face plate of the printhead 304 to prevent the tray 420 from interfering with the media web 460, while the second end 428 is substantially aligned with the back of the printhead 304. The tray 420 of the embodiment of FIG. 1 is sloped from the first end 424 to the second end 428 to enable ink collected in the tray 420 to flow toward the second end 428 of the tray 420. The second end 428 of the ink collecting tray 420 includes at least one opening to enable the ink in the second end 428 of the tray 420 to flow into the ink recirculation system 442. The roof 432 of the tray 420 is positioned between the floor of the tray 420 and the reservoir housing 380. The tray roof 432 includes sealing members 436, which extend in the cross-process direction across the width of the printhead 304 to seal the reservoir housing 380 with a lower flange 384 and enclose the upper portion of the tray 420 to prevent ink from collecting on the bottom of the exterior of the reservoir housing 380 or above the lower flange 384.

The printhead 304 includes a jet stack 320, a heater shield 360, a reservoir housing 380, and an ink reservoir 440. The jet stack 320 includes a brazed portion 322 and an adhesive layer 340. The brazed portion 322 is formed of a plurality of brazed plates bonded together, one of which is the jet stack faceplate 324. The faceplate 324 includes a plurality of apertures, each aperture including an inkjet ejector 328 that is fluidly connected to the ink reservoir 440 through pathways in the jet stack 420 and heater shield 360. The faceplate 324 is directed toward the media web 460 to enable the inkjet ejectors 328 to eject drops of ink onto the surface 464 of the media 460 in response to electrical signals being delivered to the ejectors from a controller (not shown). The adhesive layer 340 of the jet stack 320 bonds the back of the brazed portion 322 of the jet stack 320 to the heater shield 360 and includes one or more layers of adhesive, a heater, and flexible pathways to fluidly connect the inkjet ejectors 328 to the ink reservoir 440. As discussed below, the adhesive layer 340 extends below the brazed portion 322 to form a portion of the stepped flow path 400 directing the ink from the faceplate 324 to the tray 420.

The heater shield 360 bonded to the back of the inkjet stack 320 by the adhesive layer 340 is also attached to a heat sink 368 and a heater 372. The heater shield 360 is formed of a thermally conductive material to enable the heater shield 360 to spread the heat generated by the heater 372 uniformly across the printhead 304 and conduct the heat to the jet stack 320 and ink reservoir 440. The heat sink 368 is positioned on the back of the heater shield 360, within the ink reservoir 440, to conduct the heat generated by the heater 372 to the reservoir 440 and melt ink in the ink reservoir 440. The heater shield 360 extends below the adhesive layer 340 of the jet stack 320 to form another portion of the stepped flow path 400 for ink to travel from the printhead 304 to the tray 420.

The reservoir housing 380 is substantially C-shaped, with each end in the cross-process direction being enclosed to enable the open end of the reservoir housing 380 to be sealed to the back of the heater shield 360 to define a volume between the heater shield 360 and the reservoir housing 380. The volume within the reservoir housing 380 forms the ink reservoir 440, which stores ink received from ink melting assemblies (not shown) until the ink is ejected by or purged from the inkjet ejectors 328. The reservoir housing 380 includes a lower flange 384 extending downwardly and curving away from a junction with the bottom of the heater shield 360 to direct ink towards the second end 428 of the collecting tray 420. The lower flange 384 increases the structural integrity of the reservoir housing 380 and, as discussed in detail below, provides another portion of the flow path 400 for ink to flow from the jet stack faceplate 324 into the tray 420.

The brazed portion 322 of the jet stack 320 includes a lower surface 336 and a junction 332 between the faceplate 324 and the lower surface 336 to enable the ink flowing down the faceplate 324 to flow around the junction 332 to the lower surface 336 of the brazed portion 322 by surface tension forces. The adhesive layer 340 of the jet stack 320 contacts and extends below the lower surface 336 of the brazed portion 322 to enable ink to transfer from the lower surface 336 of the brazed portion 322 onto the adhesive layer 340. Ink then moves from the front of the adhesive layer 340 to a lower surface 344 of the adhesive layer 340. The ink is directed to a portion of the heater shield 360 that contacts and extends below the lower surface 344 of the adhesive layer 340, where the ink flows downwardly by gravity to a lower surface 364 of the heater shield 360. A curved surface 388 on the lower flange 384 of the reservoir housing 380 receives ink from the lower surface 364 of the heater shield 360. Surface tension forces in the ink enable the ink to flow along the curved surface of the lower flange 384 toward the second end 428 of the ink collecting tray 320 until gravity pulls the ink into the tray 420.

The ink recirculation system 442 includes a pump 444, a recirculation path 448, and a filter 452. The ink collected in the tray 420 flows down the sloped tray floor toward the second end 428 of the tray 420 and through the filter 452 to remove particles and debris in the ink and prepare the ink for reuse. The ink is moved by pump 444 through the recirculation path 448 back to the ink reservoir 440 in the printhead 304 for reuse.

When the printer in which the printing apparatus is installed performs a purge cycle, pressure is applied to the ink reservoir 440. In response to the pressure in the ink reservoir 440, ink flows from the inkjet ejectors 328 down the jet stack faceplate 324 until the ink reaches the junction 332 between the faceplate 324 and the lower surface 336 of the brazed portion 322 of the jet stack 320. The ink follows the stepped flow path 400, flowing around the junction 332 to the lower surface 336 of the brazed portion 322, the adhesive layer 340 of the jet stack 320, the lower surface 344 of the adhesive portion 340, the heater shield 360, the lower surface 364 of the heater shield 360, the curved surface 388 of the lower flange 384 of the reservoir housing 380, before dripping into the ink collecting tray 420. The surface energy of the ink enables the ink to follow the stepped flow path 400 to move toward the second end 428 of the tray 420 before dropping into the tray 420.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printer comprising:

a rotating imaging drum;

a tray having a first end and a second end; and a printhead positioned adjacent the rotating imaging drum, the printhead comprising:

a jet stack having a lower surface that joins a faceplate containing a plurality of apertures at a junction, each aperture in the plurality of apertures including an inkjet ejector configured to eject ink onto a surface of the rotating imaging drum, the faceplate being positioned above the tray between the first end and the second end of the tray and configured to enable ink purged through the inkjet ejectors to flow down the faceplate under gravity, around the junction between the faceplate and the lower surface of the jet stack, and onto the lower surface of the jet stack;

a thermal conductor operatively connected to the jet stack and extending below the lower surface of the jet stack, the thermal conductor being positioned between the lower surface of the jet stack and the second end of the tray and configured to receive ink from the lower surface of the jet stack, and a reservoir housing that forms an ink reservoir that is fluidly connected to the inkjet ejectors, the reservoir housing being positioned between the jet stack and the second end of the tray and including a lower flange configured to extend below the lower surface of the jet stack and the thermal conductor to receive ink from the lower surface of the jet stack and the thermal conductor, the lower flange having a curvature that enables the ink received from the lower surface of the jet stack and the thermal conductor to flow toward the second end of the tray and drop into the tray between the first and second ends of the tray.

2. The printer of claim 1, the jet stack further comprising:

an adhesive layer positioned between the faceplate and the thermal conductor, the adhesive layer including a lower surface operatively connected to and extending below the lower surface of the jet stack, the adhesive layer being configured to receive ink from the lower surface of the jet stack and a portion of the thermal conductor and direct the ink to the lower flange of the reservoir housing.

3. The printer of claim 1, the jet stack, thermal conductor, and lower flange of the reservoir housing forming a stepped flow path for ink purged from the inkjets to flow away from the faceplate to the lower flange of the reservoir housing before dropping into the tray.

4. The printer of claim 1 wherein at least one of the lower surface of the jet stack, the thermal conductor, and the lower flange of the reservoir housing are coated with a hydrophobic agent.

5. The printer of claim 1, the tray further comprising:

a roof positioned between the lower flange of the reservoir housing and the ink reservoir to prevent ink from collecting between the lower flange and the ink reservoir.

6. A printer comprising:

a media web;

a tray having a first end and a second end; and a printhead positioned adjacent the media web, the printhead comprising:

a jet stack having a lower surface that joins a faceplate containing a plurality of apertures at a junction, each aperture in the plurality of apertures including an inkjet ejector configured to eject ink onto a surface of the media web, the faceplate being positioned above the first end of the tray and configured to enable ink purged through the inkjet ejectors to flow down the faceplate under gravity, around the junction between the faceplate and lower surface, and onto the lower surface of the jet stack;

a thermal conductor operatively connected to the jet stack and extending below the lower surface of the jet stack, the thermal conductor being positioned between the lower surface of the jet stack and the second end of the tray and configured to receive ink from the lower surface of the jet stack; and a reservoir housing that forms an ink reservoir that is fluidly connected to the inkjet ejectors, the reservoir housing being positioned between the jet stack and the second end of the tray and including a lower flange configured to extend below the lower surface of the jet stack to receive ink from the lower surface of the jet stack and the thermal conductor, the lower flange having a curvature that enables the ink received from the jet stack to flow toward the second end of the tray and drop into the tray between the first and second ends of the tray.

7. The printer of claim 6, the jet stack further comprising:

an adhesive layer positioned between the iet stack and the thermal conductor, the adhesive layer including a second lower surface operatively connected to and extending below the lower surface of the jet stack, the adhesive layer being configured to receive ink from the lower surface of the jet stack and direct the ink to the lower flange of the reservoir housing.

8. The printer of claim 6, the jet stack, thermal conductor, and lower flange of the reservoir housing forming a stepped flow path for ink purged from the inkjets to flow away from the faceplate to the lower flange of the reservoir housing before dropping into the tray.

9. The printing apparatus of claim 6 wherein at least one of the lower surface of the jet stack, the thermal conductor, and the lower flange of the reservoir housing are coated with a hydrophobic agent.

10. The printing apparatus of claim 6, the tray further comprising:

a roof positioned between the lower flange of the reservoir housing and the ink reservoir to prevent ink from collecting between the lower flange and the ink reservoir.

* * * * *